US008573138B2

(12) United States Patent
Unger

(10) Patent No.: US 8,573,138 B2
(45) Date of Patent: Nov. 5, 2013

(54) PORTABLE TABLE

(76) Inventor: David A. Unger, Winnipeg (CA)

( * ) Notice: Subject to any disclaimer, the term of this patent is extended or adjusted under 35 U.S.C. 154(b) by 0 days.

(21) Appl. No.: 13/279,453

(22) Filed: Oct. 24, 2011

(65) Prior Publication Data

US 2012/0132113 A1 May 31, 2012

(30) Foreign Application Priority Data

Nov. 26, 2010 (CA) ..... 2722908

(51) Int. Cl.
*A47B 7/00* (2006.01)

(52) U.S. Cl.
USPC ..... 108/91; 108/26; 108/50.11; 108/150

(58) Field of Classification Search
USPC ..... 108/26, 42, 50.12, 50.11, 91, 92, 101, 108/180, 183, 150, 151, 153.1, 157.1, 108/158.11, 157.16, 157.17, 159; 248/156, 248/545, 530, 188.1; 211/196, 205, 133.4; 297/188.2, 188.21, 170, 172
See application file for complete search history.

(56) References Cited

U.S. PATENT DOCUMENTS

| | | | | | |
|---|---|---|---|---|---|
| 2,628,797 | A | * | 2/1953 | Campomar | 248/545 |
| 2,937,761 | A | * | 5/1960 | Reed | 108/62 |
| 3,116,046 | A | * | 12/1963 | Risdon | 248/231.81 |
| 3,170,612 | A | * | 2/1965 | Blumenschein | 294/143 |
| 4,063,701 | A | * | 12/1977 | Wray | 248/292.14 |
| 4,218,979 | A | * | 8/1980 | Esposito et al. | 108/106 |
| 4,407,475 | A | | 10/1983 | Gossage | |
| D286,591 | S | | 11/1986 | Russell | |
| D298,296 | S | | 11/1988 | Washburn et al. | |
| 4,852,835 | A | | 8/1989 | Ciulli | |
| 5,197,394 | A | * | 3/1993 | Schmidt | 108/50.12 |
| 5,353,716 | A | * | 10/1994 | Wilbert | 108/150 |
| 5,356,107 | A | * | 10/1994 | Sinohuiz | 248/311.2 |
| D353,742 | S | | 12/1994 | Lewis et al. | |
| 5,762,004 | A | | 6/1998 | Vashon et al. | |
| 5,860,534 | A | | 1/1999 | Minneman et al. | |
| 5,934,634 | A | * | 8/1999 | Lindblom | 248/230.1 |
| 6,409,131 | B1 | * | 6/2002 | Bentley et al. | 248/219.4 |
| 6,487,977 | B1 | * | 12/2002 | Williams et al. | 108/50.12 |
| 6,705,240 | B2 | | 3/2004 | Block et al. | |
| 6,948,694 | B1 | * | 9/2005 | Gilbert | 248/530 |
| 7,111,812 | B2 | * | 9/2006 | Shannon et al. | 248/230.7 |
| 7,717,382 | B2 | * | 5/2010 | Whittemore et al. | 248/230.4 |
| 8,276,524 | B2 | * | 10/2012 | Goode et al. | 108/94 |
| 2006/0021549 | A1 | * | 2/2006 | Theinert | 108/91 |
| 2006/0169186 | A1 | * | 8/2006 | Theinert | 108/91 |
| 2007/0158525 | A1 | * | 7/2007 | Anderson | 248/514 |
| 2007/0246091 | A1 | * | 10/2007 | Becker | 135/16 |
| 2010/0163086 | A1 | * | 7/2010 | Chavez et al. | 135/16 |

* cited by examiner

*Primary Examiner* — Janet M Wilkens
*Assistant Examiner* — Daniel Rohrhoff
(74) *Attorney, Agent, or Firm* — Ryan W. Dupuis; Kyle R. Satterthwaite; Ade & Company Inc

(57) ABSTRACT

A portable table includes a pedestal arranged to be penetrated into the ground and a tray member arranged to be selectively supported on a top end of the pedestal so as to remain readily separable for transport or storage. A beverage holder arranged to be slidably supported on an upper portion of the pedestal. The pedestal has an offset portion arranged to prevent downwardly sliding of the beverage holder below the upper portion of the pedestal. The tray member includes an upper supporting surface and stiffening ribs therebelow having a matching profile for nested stacking of a plurality of tray members separated from their respective pedestals.

12 Claims, 6 Drawing Sheets

PORTABLE TABLE

This application claims foreign priority benefits from Canadian Patent Application 2,722,908, filed Nov. 26, 2010.

FIELD OF THE INVENTION

The present invention relates to a portable table comprising a pedestal arranged to be penetrated into the ground and a tray member arranged to be selectively supported on a top end of the pedestal so as to remain readily separable for transport or storage. More particularly, the present invention relates to a portable table including a pedestal, a tray member, and a beverage holder arranged to be selectively supported on the pedestal.

BACKGROUND

In many instances, it is desirable to make use of a temporary or portable table, for example during outdoor activities such as camping and the like where a user may be using a portable lawn chair. In these instances, it is desirable for the portable table to be readily collapsible for ease of transport and storage.

Various examples of portable tables and related devices are disclosed in the following U.S. Pat. No. 286,591 by Russell; U.S. Pat. No. 2,937,761 by Reed; U.S. Pat. No. 3,116,046 by Risdon; U.S. Pat. No. 6,705,240 by Block et al.; U.S. Pat. No. 5,762,004 by Vashon et al.; U.S. Pat. No. 4,852,835 by Ciulli; U.S. Pat. No. 4,407,475 by Gossage; U.S. Pat. No. 5,860,534 by Minneman et al.; U.S. Pat. No. 353,742 by Lewis et al.; and U.S. Pat. No. 298,296 by Washburn et al.

Prior devices commonly have a pedestal supporting a tray member thereon such that the tray and pedestal are readily separable for transport or storage. When providing multiple tables for different users, it is desirable for the tables to be stored in the most compact manner relative to one another while providing a table which remains strong and lightweight in use. It is further desirable to incorporate support for a beverage in conjunction with the tray member.

SUMMARY OF THE INVENTION

According to one aspect of the invention there is provided a portable table comprising:

a pedestal extending in a longitudinal direction between a bottom end arranged for penetration into the ground and an opposing top end;

a tray member arranged to be selectively supported on the top end of the pedestal, the tray member comprising:

an upright side wall extending about a perimeter of the tray member;

an upper supporting panel joined to a top edge of the upright side wall so as to span across a top side of the tray member;

the upper supporting panel including a central portion which is recessed in relation to the top edge of the upright side wall and a perimeter portion about the central portion which is sloped downwardly and inwardly from the top edge of the upright side wall to the central portion;

a connecting portion centrally located below the upper supporting panel and arranged for selective coupling to the top end of the pedestal such that the central portion of the upper supporting panel is arranged to be supported perpendicularly to the longitudinal direction of the pedestal; and a plurality of upright ribs spanning radially outward from an inner end integrally moulded with the connecting portion to an outer end integrally moulded with the upright side wall;

each rib spanning generally vertically between a top edge integrally moulded with the upper supporting panel and a bottom edge having a profile which corresponds to a profile of an upper surface of the upper supporting panel thereabove such that a bottom side of the tray member is arranged for nesting with the top side of a second tray member of like configuration stacked therebelow.

The configuration of the ribs under the upper supporting panel of the tray member provides a balance of maximum support for the upper supporting panel in use while supporting stacked tray members relative to one another in an optimally nested manner.

A height between the upper surface of the upper supporting panel and the bottom edge of each rib is preferably substantially constant between the connecting portion and the upright side wall.

There may be provided a peripheral lip projecting downwardly from a bottom edge of the upright side wall about the perimeter of the tray member. The peripheral lip preferably has an interior diameter corresponding to an outer diameter of the upright side wall such that the peripheral lip is arranged to receive the second tray member of like configuration nested therein.

The connecting portion may comprise a socket having an inner surface arranged to surround the top end of the pedestal arranged to be slidably received therein and a plurality of ribs integrally molded of plastic material with the socket such that the ribs extend in the longitudinal direction of the pedestal and such that the ribs project radially inwardly from the inner surface at circumferentially spaced positions about the top end of the pedestal for engaging the pedestal. Preferably the ribs are suitably sized such that the ribs are under compression between the inner surface of the socket and the outer surface of the pedestal.

Preferably at least the central portion of the upper surface of the upper supporting panel comprises a texture having a high coefficient of friction.

The portable table may further comprise a beverage holder comprising a mounting portion arranged for mounting onto the pedestal and a receptacle portion integrally moulded with the mounting portion and being arranged to support a beverage container therein. In this instance, the mounting portion of the beverage holder preferably comprises a socket having an inner surface arranged to surround the pedestal so as to be slidable along the pedestal in the longitudinal direction.

Also in this instance, the pedestal preferably comprises an elongate rod member which is continuous between the top and bottom ends of the pedestal and which includes: an upper portion extending along the common vertical axis adjacent the top end of the pedestal such that the socket of the mounting portion of the beverage holder is arranged to be slidable along the common vertical axis relative to the pedestal along the upper portion; and an intermediate portion below the upper portion which is bent so as to be offset in a radial direction from the common vertical axis of the top and bottom ends of the pedestal such that the beverage holder is prevented from sliding downwardly along the pedestal past the intermediate portion.

The mounting portion of the beverage holder may also comprise: a socket having an inner surface arranged to surround the pedestal so as to be slidable along the pedestal in the longitudinal direction; and a plurality of ribs integrally molded of plastic material with the socket such that the ribs extend in the longitudinal direction of the pedestal and such that the ribs project radially inwardly from the inner surface at circumferentially spaced positions about the pedestal for engaging the pedestal. In this instance, the ribs are preferably suitably sized such that the ribs are under compression between the inner surface of the socket and the outer surface of the pedestal and the mounting portion is arranged to frictionally resist sliding movement of the socket along the pedestal in the longitudinal direction.

According to a second aspect of the present invention there is provided a portable table comprising:

a pedestal extending in a longitudinal direction between a bottom end arranged for penetration into the ground and an opposing top end in alignment with the bottom end along a common vertical axis extending in the longitudinal direction;

a tray member arranged to be selectively supported on the top end of the pedestal, the tray member comprising an upper supporting panel and a connecting portion centrally located below the upper supporting panel and arranged for selective coupling to the top end of the pedestal such that the upper supporting panel is arranged to be supported generally perpendicularly to the longitudinal direction of the pedestal; and a beverage holder comprising a mounting portion arranged for mounting onto the pedestal and a receptacle portion integrally moulded with the mounting portion and being arranged to support a beverage container therein;

the mounting portion of the beverage holder comprising a socket having an inner surface arranged to surround the pedestal so as to be slidable along the pedestal in the longitudinal direction; and the pedestal comprising an elongate rod member which is continuous between the top and bottom ends of the pedestal and which includes:

an upper portion extending along the common vertical axis adjacent the top end of the pedestal such that the socket of the mounting portion of the beverage holder is arranged to be slidable along the common vertical axis relative to the pedestal along the upper portion; and an intermediate portion below the upper portion which is bent so as to be offset in a radial direction from the common vertical axis of the top and bottom ends of the pedestal such that the beverage holder is prevented from sliding downwardly along the pedestal past the intermediate portion.

By further providing an intermediate portion which is offset from top and bottom ends of the pedestal which remain aligned with one another, a simple support is provided for a separable beverage holder while the top and bottom ends of the pedestal remain aligned for optimal balance of the tray member on the top end thereof.

Preferably the intermediate portion spans at least half an overall length of the pedestal in the longitudinal direction.

The intermediate portion preferably includes an upper arm extending generally radially outward from the common vertical axis adjacent the upper portion, a lower arm extending generally radially outward from the common vertical axis at a location spaced below the upper arm, and an upright leg spanning between the upper arm and the lower arm at a location parallel to and spaced radially from the common vertical axis.

The pedestal preferably further includes a bottom portion extending along the common vertical axis below the bottom arm in which the bottom portion is arranged to be fully penetrated into the ground such that the bottom arm is arranged to engage a surface of the ground in use.

The beverage holder and the tray member are preferably molded of a common plastic material while the pedestal comprises a metallic rod member.

When the beverage holder comprises a horizontal bottom member upon which a beverage container is arranged to be supported, preferably the bottom member includes at least one drainage aperture formed therein.

According to a further aspect of the present invention there is provided a portable table comprising:

a pedestal extending in a longitudinal direction between a bottom end arranged for penetration into the ground and an opposing top end;

a tray member arranged to be selectively supported on the top end of the pedestal, the tray member comprising an upper supporting panel and a connecting portion centrally located below the upper supporting panel and arranged for selective coupling to the top end of the pedestal such that the upper supporting panel is arranged to be supported generally perpendicularly to the longitudinal direction of the pedestal; and a beverage holder comprising a mounting portion arranged for mounting onto the pedestal and a receptacle portion integrally moulded with the mounting portion and being arranged to support a beverage container therein;

the mounting portion of the beverage holder comprising:

a socket having an inner surface arranged to surround the pedestal so as to be slidable along the pedestal in the longitudinal direction; and a plurality of ribs integrally molded of plastic material with the socket such that the ribs extend in the longitudinal direction of the pedestal and such that the ribs project radially inwardly from the inner surface at circumferentially spaced positions about the pedestal for engaging the pedestal;

the ribs being suitably sized such that the ribs are under compression between the inner surface of the socket and the outer surface of the pedestal.

The ribs may also be arranged so that the mounting portion is arranged to frictionally resist sliding movement of the socket along the pedestal in the longitudinal direction.

Further support may be provided to a beverage holder by use of the circumferentially spaced ribs on the socket of the mounting portion which receives the pedestal therethrough. These ribs ensure a snug fit between the beverage holder and the pedestal for stability in use while remaining readily separable when desired for storage.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
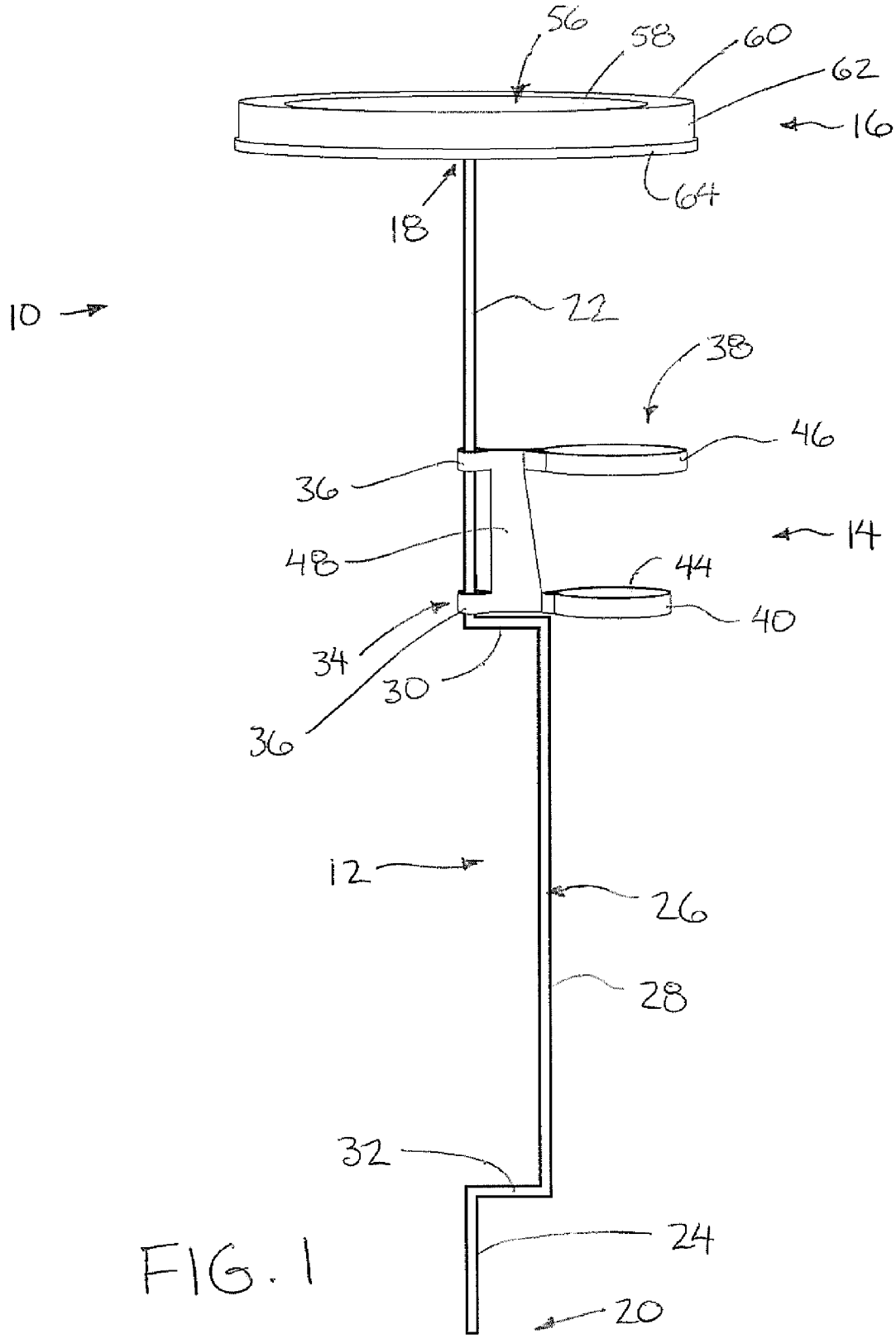
FIG. 1 is a perspective view of the assembled portable table.
Figure 2:
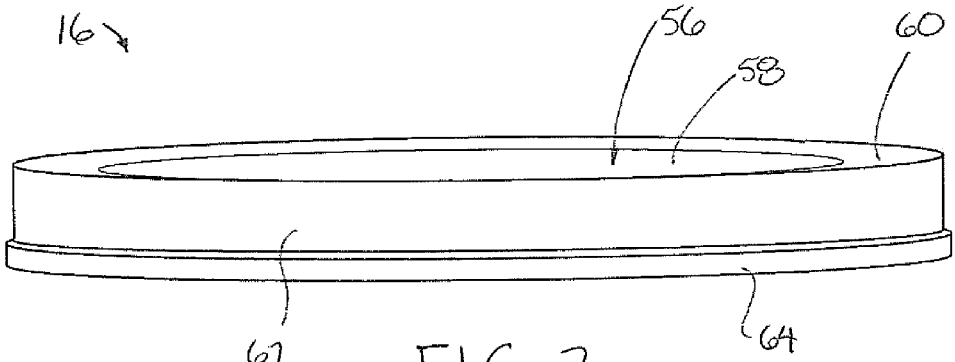
FIG. 2 is a perspective view of the tray member shown separated from the pedestal.
Figure 3:
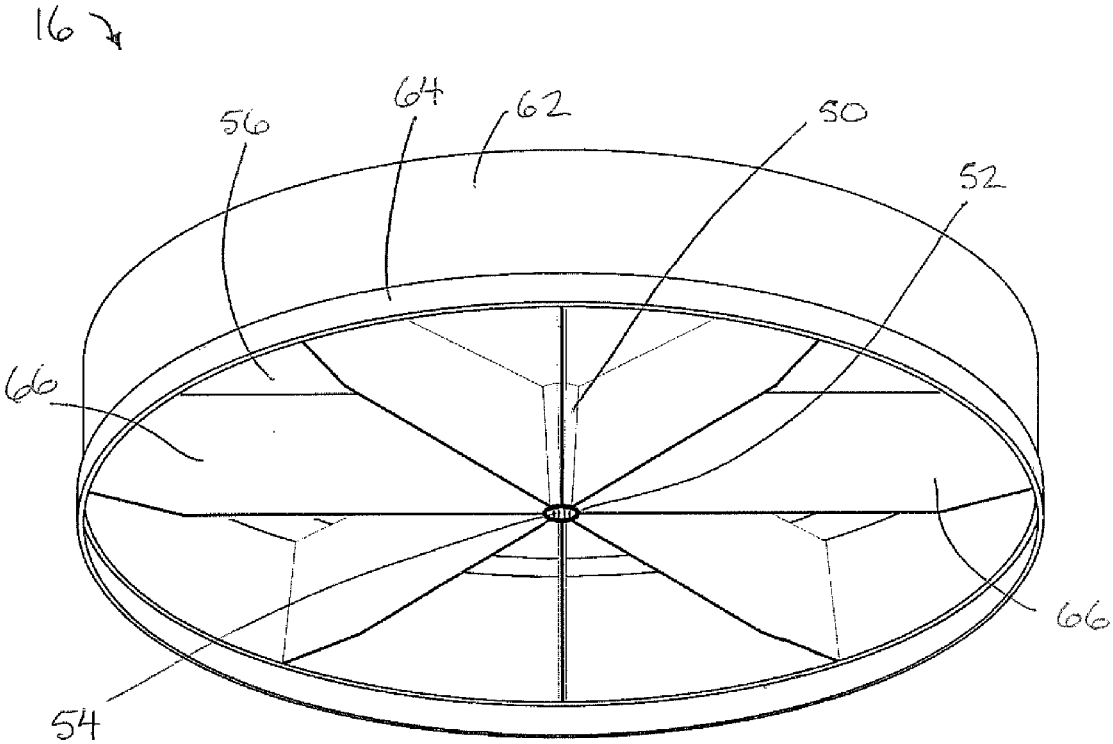
FIG. 3 is a perspective view of a bottom side of the tray member.
Figure 4:
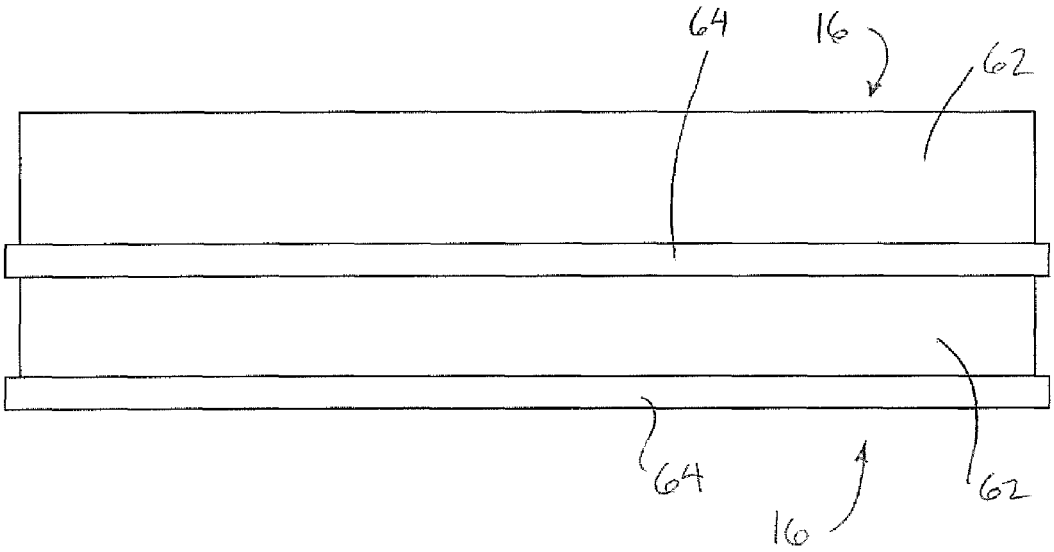
FIG. 4 is a side elevational view of a pair of tray members stacked in a nested configuration with one another.
Figure 5:
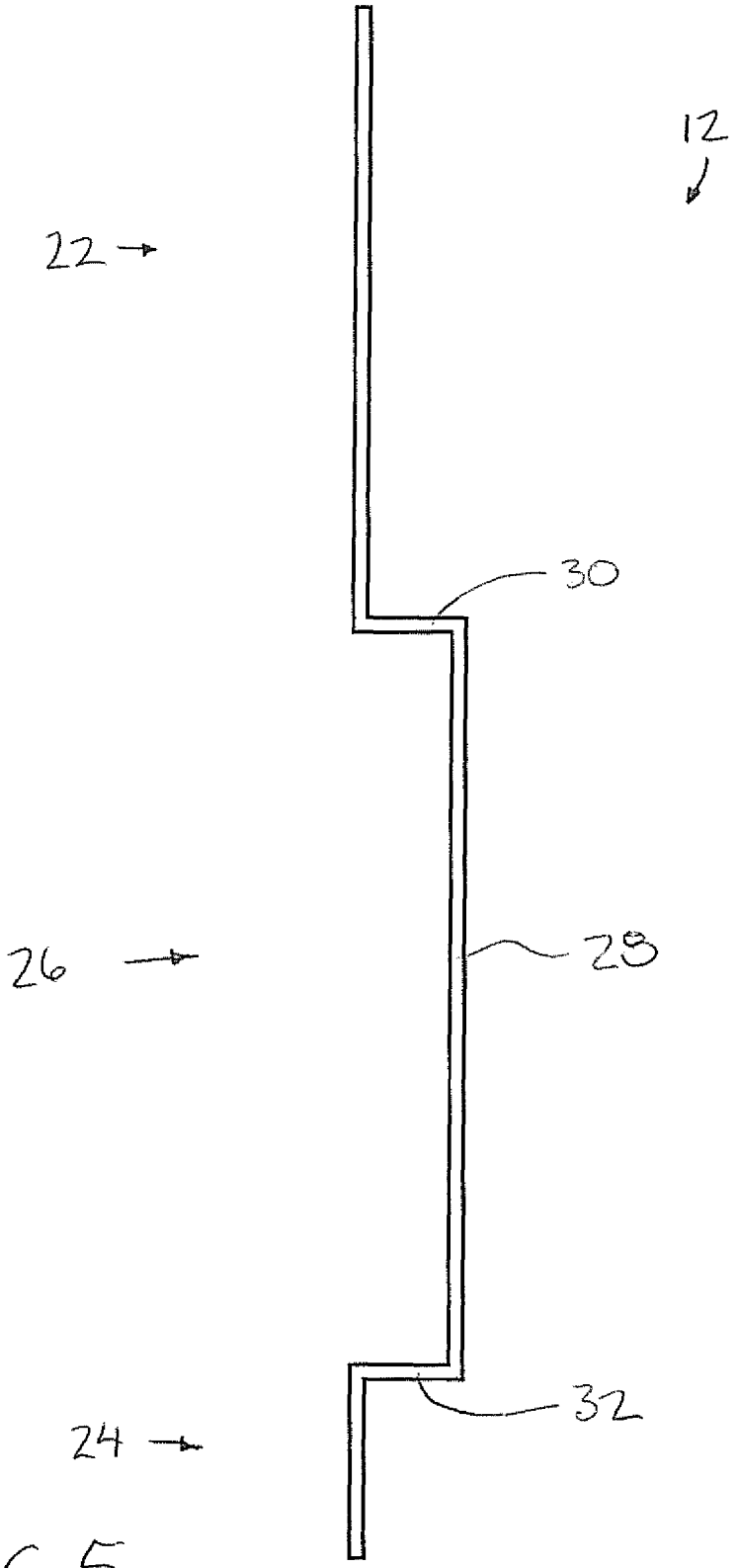
FIG. 5 is an elevational view of the pedestal.
Figure 6:
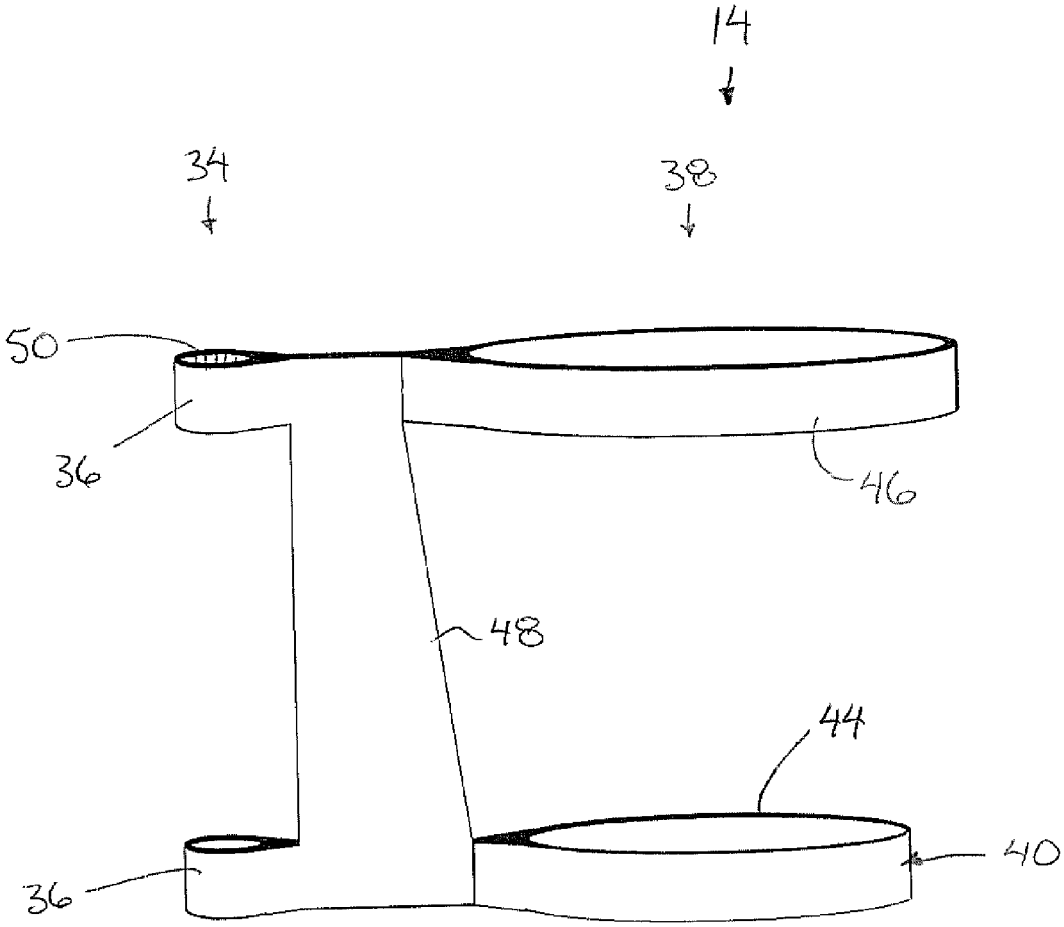
FIG. 6 is a perspective top view of the beverage holder shown separated from the pedestal.
Figure 7:
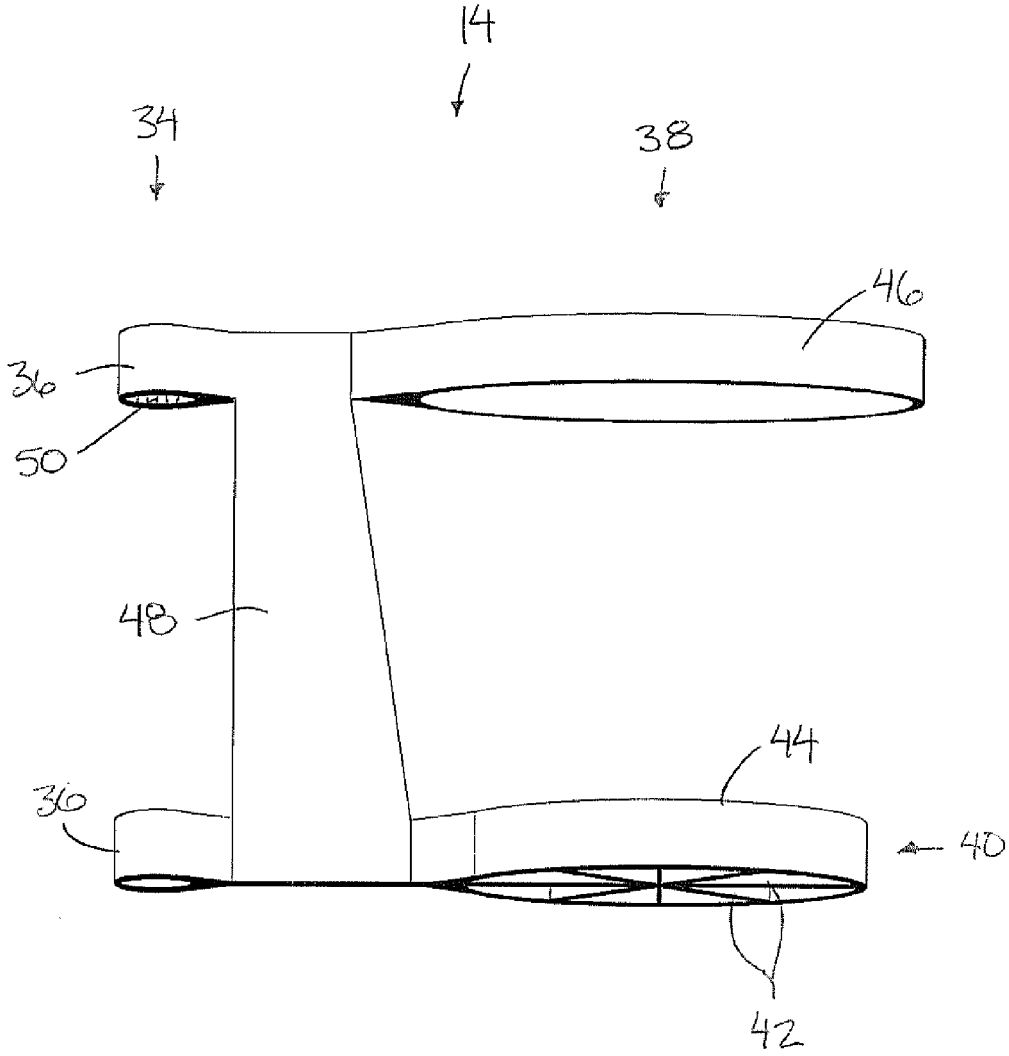
FIG. 7 is a perspective bottom view of the beverage holder.

Referring to the accompanying figures, there is illustrated a portable table generally indicated by reference numeral 10.

The table 10 generally comprises a pedestal 12 arranged to be penetrated into the ground, as well as a beverage holder 14 and a tray member 16 arranged to be selectively supported on the pedestal such that the tray member and beverage holder can be readily separated from the pedestal for transport and storage.

The pedestal 12 generally comprises an elongate rigid metal wire rod which extends generally in a longitudinal direction between a top end 18 and a bottom end 20. The top and bottom ends are in alignment with one another so as to be coaxial along a common vertical axis which extends in the longitudinal direction of the pedestal.

More particularly, the pedestal includes an upper portion 22 extending along the common vertical axis adjacent the top end and a lower portion 24 which similarly extends along the common vertical axis adjacent the bottom end. The lower portion 24 is shorter than the upper portion so as to be near approximately $1/10^{th}$ of an overall length of the pedestal in the longitudinal direction so as to be arranged to be fully penetrated into the ground in use. The upper portion is longer so as to be in the range of ⅓ to ½ of the overall length of the pedestal.

The pedestal further includes an intermediate portion 26 extending between the upper and lower portions. The intermediate portion includes an upright leg 28 spanning vertically so as to be parallel to the common vertical axis at a location offset radially outward from the axis. The upright leg has a length corresponding to approximately ½ of the overall length of the pedestal or more. The top and bottom ends of the upright leg 28 are joined to the upper portion and lower portion of the pedestal by an upper arm 30 and a lower arm 32 respectively.

Each of the upper and lower arms extends generally horizontally so as to span radially outward in relation to the common vertical axis between the respective upper or lower portion of the pedestal and the upright leg 28 of the intermediate portion. The lower arm 32 provides a suitable shoulder upon which a user may step to assist in penetrating the lower portion 24 into the ground. Upon insertion of the lower portion into the ground, the lower arm engages an upper surface of the ground to provide additional support to the pedestal. The upper arm 30 also forms a suitable shoulder which can be readily grasped in the hand of the user to assist in pulling the pedestal out of the ground after use.

The upper portion 22, the lower portion 24 and the components of the intermediate portion 26 are all formed of a continuous single wire rod member which has been bent to form the desired shape of the upright leg being offset from the common vertical axis.

The beverage holder 14 comprises a single member integrally molded of plastic material. The holder 14 includes a mounting portion 34 having two vertically spaced sockets 36 arranged to slidably receive the upper portion 22 of the pedestal therethrough such that the beverage holder is slidable in the longitudinal direction of the pedestal between the top end and the upper arm along the upper portion 22. Each socket 36 has a generally cylindrical inner surface arranged to fully surround the upper portion of the pedestal with the socket extending in the longitudinal direction between opposed open ends through which the rod of the pedestal is received.

The beverage holder further comprises a receptacle portion 38 arranged to support a beverage container thereon. The receptacle portion includes a bottom member 40 arranged to span generally horizontally at the bottom end of the beverage holder. The bottom member 40 comprises a circular supporting member formed by a plurality of radially extending arms 42 defining drainage apertures between adjacent arms which prevents the accumulation of liquids thereon. The arms 42 are joined to one another at a center of the bottom member while being joined by a perimeter wall 44 at the outer ends thereof. The perimeter wall is generally cylindrical in shape and extends upward beyond an upper supporting surface defined by the arms 42 to assist in locating a beverage container essentially on the upper supporting surface of the bottom member.

The receptacle portion 38 further comprises a top member 46 comprising an annular ring which is concentric with the bottom member 40 at a location spaced above the bottom member at the top end of the beverage holder. The top member is suitably sized to receive a conventional single serving size beverage bottle or can therein for example or a conventional sized styrofoam cup for example. The beverage holder is open between the top and bottom members.

The beverage holder further comprises a web portion 48 spanning vertically between the top and bottom member as well as being joined between the two sockets of the mounting portion. The two sockets are spaced apart at opposing top and bottom ends of the beverage holder so as to be at a common elevation with the top member and bottom member of the receptacle portion respectively. The mounting portion and the receptacle portion are connected to opposing sides of the web portion 48 therebetween.

In use, the two sockets 36 of the beverage holder slide onto the upper portion of the pedestal so as to be readily removable off of the top end of the pedestal for storage. In use, the beverage holder is prevented from sliding downwardly to the intermediate portion of the pedestal by the bend between the upper portion 22 and the upper arm of the intermediate portion which the sockets cannot slide past.

Further support to the beverage holder is provided by a plurality of ribs 50 integrally molded onto an inner surface of at least one of the sockets 36. The ribs extend vertically in the longitudinal direction at circumferentially spaced positions about the inner surface such that each rib extends radially inwardly for engaging the outer surface of the pedestal at the inner free end of the rib. The ribs are suitably sized for being snugly fit under compression between the outer surface of the pedestal and the inner surface of the socket in use. The ribs allow a snug fit while also permitting the upper portion of the pedestal to be more readily inserted into the socket. The ribs may be suitably sized such that the ribs act to frictionally resist sliding movement of the beverage holder along the pedestal as may be desired for additional support.

The tray member 16 also comprises a single molded member which is formed of the same plastic material as the beverage holder. The tray member includes a connecting portion 50 located centrally at the bottom side of the tray member in the form of a tubular socket 52 slidably receiving the top end of the pedestal therein. Similarly to the sockets of the beverage holder, the socket 52 of the tray member has an inner surface which is generally cylindrical to surround the rod forming the top end of the pedestal. Ribs 54 are also provided on the inner surface to extend vertically in the longitudinal direction at circumferentially spaced positions such that the ribs extend radially inwardly for engaging the pedestal in use. The ribs 54 are also suitably sized to be under compression between the outer surface of the pedestal and the inner surface of the socket when the top end of the pedestal is slidably inserted into the socket 52 in use.

The tray member further comprises an upper supporting panel 56 at the top end of the tray member such that the connecting portion 50 is centrally located therebelow. The upper supporting panel 56 is generally circular and mostly spans horizontally so as to be perpendicular to the longitudinal direction of the rod received within the socket 52. The connecting portion is centered relative to the upper supporting panel.

The upper supporting panel includes a central portion 58 which is circular and coaxial with the socket of the connecting portion and which is perpendicular to the longitudinal axis. The central portion 58 is surrounded by a perimeter portion 60 which is sloped downwardly and inwardly from an outer perimeter of the upright supporting panel defining the top end of the tray member to the central portion which is recessed downwardly relative to the top end formed by the perimeter edge.

The upper supporting panel spans the full top end of the tray member with the perimeter portion 60 fully surrounding the central portion such that any liquids accumulated on the tray member are directed inwardly to the central portion 58 so as to be retained thereon. More particularly, the profile of the upper supporting panel serves to centrally locate a plate onto the central portion with the perimeter portion 60 providing some resistance to the plate from sliding laterally off of the top end of the tray member.

Typically the upper surface of the upper supporting panel is roughly textured, or otherwise includes a high coefficient of friction by a coating of gripping material for example, so as to further resist lateral sliding of a plate supported on the tray member relative to the upper supporting panel thereof.

The tray member further comprises a side wall 62 which is vertical in orientation so as to be substantially cylindrical in shape about the perimeter of the upright supporting panel while being parallel to the longitudinal direction of the pedestal received in the connecting portion of the tray member. A top end of the side wall is joined to the outer edge of the upright supporting panel such that the top end of the side wall 62 defines the top end of the tray member relative to which the central portion 58 is recessed. The side wall is coaxial with the socket of the connecting portion.

The tray member further comprises a peripheral lip 64 depending downwardly from the bottom end of the side wall 62 about the full perimeter thereof at a location radially outward from the side wall such that an inner diameter of the peripheral lip 64 corresponds approximately to the outer diameter of the remainder of the side wall 62 thereabove. In this manner the peripheral lip 64 is arranged to receive the top edge of a second tray member of like configuration nested therein when the tray members are stacked.

The tray member further comprises a plurality of ribs 66 in the form of upright panels spanning vertically between respective top and bottom edges, as well as spanning radially between inner ends connected to the connecting portion 50 and outer ends connected to the side wall 62 respectively. The top edge of each rib is integrally joined to the upper supporting panel. At the outer end, the bottom edge of each rib terminates at a bottom edge of the side wall. At the inner end, the bottom edge of each rib terminates at the bottom edge of the connecting portion.

Between the inner and outer ends, the bottom edge of each rib has a profile which matches the profile of the upper surface of the upper supporting panel 56. Accordingly, a height between the upper surface of the upper supporting panel and the bottom edge of the rib remains constant from the inner end at the connecting portion to the outer end at the side wall. Accordingly a central portion of the bottom edges of the ribs are arranged to be nested within the recessed central portion of the second tray member of like configuration stacked therebelow in storage.

Typically several tray members are stacked with one another for storage with the beverage holders also being separated from the pedestals such that the pedestals may be readily bundled together to minimize the storage space requirements. When it is desired to use the tables, one of the pedestals is inserted into the ground by stepping on the lower arm to penetrate the lower portion of the pedestal fully into the ground. The beverage holder is then slidably mounted onto the upper portion of the pedestal by inserting the top end of the pedestal through both sockets of the mounting portion of the beverage holder until the beverage holder rests upon the upper arm of the intermediate portion. The upper arm thus provides support to a beverage container received in the receptacle portion of the beverage holder. The top end of the pedestal is then inserted into the socket of the connecting portion of the tray member such that the recessed central portion of the tray member is coaxial with the common vertical axis of the pedestal while being oriented perpendicularly to the vertical axis.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A portable table comprising:

a pedestal extending in a longitudinal direction between a bottom end arranged for penetration into the ground and an opposing top end;

a tray member arranged to be selectively supported on the top end of the pedestal, the tray member comprising:

an upright side wall extending about a perimeter of the tray member;

an upper supporting panel joined to a top edge of the upright side wall so as to span across a top side of the tray member;

the upper supporting panel including a central portion which is recessed in relation to the top edge of the upright side wall and a perimeter portion about the central portion which is sloped downwardly and inwardly from the top edge of the upright side wall to the central portion;

a connecting portion centrally located below the upper supporting panel and arranged for selective coupling to the top end of the pedestal such that the central portion of the upper supporting panel is arranged to be supported perpendicularly to the longitudinal direction of the pedestal; and a plurality of upright ribs spanning radially outward from an inner end integrally moulded with the connecting portion to an outer end integrally moulded with the upright side wall;

each rib spanning generally vertically between a top edge integrally moulded with the upper supporting panel and a bottom edge having a profile which corresponds to a profile of an upper surface of the upper supporting panel thereabove such that a bottom side of the tray member is arranged for nesting with the top side of a second tray member of like configuration stacked therebelow.

2. The portable table according to claim 1 wherein a height between the upper surface of the upper supporting panel and the bottom edge of each rib is substantially constant between the connecting portion and the upright side wall.

3. The portable table according to claim 1 wherein there is provided a peripheral lip projecting downwardly from a bottom edge of the upright side wall about the perimeter of the tray member, the peripheral lip having an interior diameter corresponding to an outer diameter of the upright side wall such that the peripheral lip is arranged to receive the second tray member of like configuration nested therein.

4. The portable table according to claim 1 wherein the connecting portion comprises a socket having an inner surface arranged to surround the top end of the pedestal arranged to be slidably received therein and a plurality of ribs integrally molded of plastic material with the socket such that the ribs extend in the longitudinal direction of the pedestal and such that the ribs project radially inwardly from the inner surface at circumferentially spaced positions about the top end of the pedestal for engaging the pedestal, the ribs being suitably sized such that the ribs are under compression between the inner surface of the socket and the outer surface of the pedestal.

5. The portable table according to claim 1 wherein at least the central portion of the upper surface of the upper supporting panel comprises a texture having a high coefficient of friction.

6. The portable table according to claim 1 further comprising:

a beverage holder comprising a mounting portion arranged for mounting onto the pedestal and a receptacle portion integrally moulded with the mounting portion and being arranged to support a beverage container therein;

the mounting portion of the beverage holder comprising a socket having an inner surface arranged to surround the pedestal so as to be slidable along the pedestal in the longitudinal direction;

the pedestal comprising an elongate rod member which is continuous between the top and bottom ends of the pedestal and which includes:

an upper portion extending along the common vertical axis adjacent the top end of the pedestal such that the socket of the mounting portion of the beverage holder is arranged to be slidable along the common vertical axis relative to the pedestal along the upper portion; and an intermediate portion below the upper portion which is bent so as to be offset in a radial direction from the common vertical axis of the top and bottom ends of the pedestal such that the beverage holder is prevented from sliding downwardly along the pedestal past the intermediate portion.

7. The portable table according to claim 6 wherein the intermediate portion spans at least half an overall length of the pedestal in the longitudinal direction.

8. The portable table according to claim 6 wherein the intermediate portion includes an upper arm extending generally radially outward from the common vertical axis adjacent the upper portion, a lower arm extending generally radially outward from the common vertical axis at a location spaced below the upper arm and an upright leg spanning between the upper arm and the lower arm at a location parallel to and spaced radially from the common vertical axis.

9. The portable table according to claim 8 wherein the pedestal includes a bottom portion extending along the common vertical axis below the bottom arm, the bottom portion being arranged to be fully penetrated into the ground such that the bottom arm is arranged to engage a surface of the ground in use.

10. The portable table according to claim 6 wherein the beverage holder and the tray member are molded of a common plastic material and wherein the pedestal comprises a metallic rod member.

11. The portable table according to claim 6 wherein the beverage holder comprises a horizontal bottom member upon which a beverage container is arranged to be supported, the bottom member including at least one drainage aperture formed therein.

12. The portable table according to claim 1 further comprising:

a beverage holder comprising a mounting portion arranged for mounting onto the pedestal and a receptacle portion integrally moulded with the mounting portion and being arranged to support a beverage container therein;

the mounting portion of the beverage holder comprising:

a socket having an inner surface arranged to surround the pedestal so as to be slidable along the pedestal in the longitudinal direction; and a plurality of ribs integrally molded of plastic material with the socket such that the ribs extend in the longitudinal direction of the pedestal and such that the ribs project radially inwardly from the inner surface at circumferentially spaced positions about the pedestal for engaging the pedestal;

the ribs being suitably sized such that the ribs are under compression between the inner surface of the socket and the outer surface of the pedestal and the mounting portion is arranged to frictionally resist sliding movement of the socket along the pedestal in the longitudinal direction.

* * * * *